US006536737B1

(12) United States Patent
Davis

(10) Patent No.: US 6,536,737 B1
(45) Date of Patent: Mar. 25, 2003

(54) CONCRETE FORM BRACE

(76) Inventor: Wade M. Davis, 1140 Powell Creek Rd., Williams, OR (US) 97544

( * ) Notice: Subject to any disclaimer, the term of this patent is extended or adjusted under 35 U.S.C. 154(b) by 0 days.

(21) Appl. No.: 09/642,048

(22) Filed: Aug. 18, 2000

(51) Int. Cl.[7] ..... E04G 17/14
(52) U.S. Cl. ..... 249/3; 249/210
(58) Field of Search ..... 249/3, 4, 5, 6, 249/7, 207, 210; 52/102

(56) References Cited

U.S. PATENT DOCUMENTS

| | | | | | |
|---|---|---|---|---|---|
| 1,348,060 | A | * | 7/1920 | Sheppard | 249/7 |
| 1,496,933 | A | * | 6/1924 | Heltzel | 249/4 |
| 1,561,923 | A | * | 11/1925 | Heltzel | 249/7 X |
| 1,939,007 | A | * | 12/1933 | Heltzel | 249/3 X |
| 2,031,612 | A | * | 2/1936 | Masor | 249/7 |
| 2,626,444 | A | * | 1/1953 | Wolf et al. | 249/8 |
| 2,845,683 | A | * | 8/1958 | Winegar | 249/5 |
| 3,785,606 | A | * | 1/1974 | Green | 249/3 |
| 4,579,312 | A | * | 4/1986 | White | 249/7 X |
| 5,096,155 | A | * | 3/1992 | Fitzgerald | 249/3 X |
| 5,156,753 | A | * | 10/1992 | Speidel | 249/5 |
| 5,817,247 | A | * | 10/1998 | Colatruglio | 249/3 X |
| 6,230,451 | B1 | * | 5/2001 | Stoller | 249/3 X |

FOREIGN PATENT DOCUMENTS

| | | | | |
|---|---|---|---|---|
| DE | 2244816 | * | 3/1974 | 249/207 |

* cited by examiner

*Primary Examiner*—Robert Canfield
(74) *Attorney, Agent, or Firm*—Steven J. Adamson

(57) ABSTRACT

A concrete form brace for bracing a concrete form board. It includes a vertical member, a support member, and a means for receiving a stake. The support member holds and supports the means for receiving a stake so that it can position a stake at an angle to the vertical member. The flat vertical member is generally mounted flush against the form board and is attached to the form board by nails, screws, or other attachment means. A stake directed through the means for receiving a stake is driven into the ground to brace the concrete form brace and form board. The stake is driven into the ground such that it clears the top of the form board.

13 Claims, 3 Drawing Sheets

CONCRETE FORM BRACE

FIELD OF THE INVENTION

The present invention is related to forms for use in the laying of concrete slabs, and, more particularly, the concrete form braces for use in holding the forms in place while the concrete slabs are being formed.

BACKGROUND OF THE INVENTION

A typical prior art apparatus for use in retaining concrete forms in place uses wooden or metal stakes which are attached by nails to wooden boards which are used as forms. As shown in FIG. 1, the typical prior art apparatus consists of a plurality of grade stakes 3 and kicker stakes 5. Each grade stake 3 is inserted vertically into the ground 6 and is attached flush against the concrete form board 1. Each kicker stake 1 is positioned so as to abut the concrete form board 1 at its top and is nailed to the concrete form board 1 at its top. The lower end of each kicker stake 5 is inserted into the ground 6 at some distance from the concrete form board, so that each kicker stake 5 is positioned at an angle to the ground 6. In this alignment, the kicker stakes 5 provide additional bracing for the concrete form board 1 when concrete or other material flows against the form board 1.

A problem with kicker stakes is that the top portion of a kicker stake extends over the concrete form board and the concrete surface contained within the form. Leveling and smoothing of the concrete within the form is usually performed by dragging a screed board across the top of the concrete surface. The top of the concrete form board is used to establish the top of the concrete surface, so the screed board generally rides on top of the concrete form board as it is being dragged across the concrete surface. Since the kicker stakes extend over the concrete form board and concrete surface, they impede the movement of the screed board on top of the form boards. Hence, the screed board can not be dragged smoothly over the entirety of the concrete surface formed within the form boards. The screed board must be picked up and moved over each stake. Such movement of the screed board slows the process of leveling and smoothing the slab and may also result in imperfections in the smoothness of the slab.

There exists a need in the art for an apparatus to brace a concrete form board that allows a screed board to be dragged smoothly and without interruption across a concrete surface.

SUMMARY OF THE INVENTION

It is an object of the present invention to provide an apparatus to brace a form board in such a manner that a screed board can be used to smooth the surface of the concrete slab formed within the concrete form without being hindered by the bracing apparatus.

A first embodiment of the concrete form brace of present invention comprises a vertical member, a substantially flat support member, and a tube for receiving a stake. The support member holds and supports the tube so that it can position a stake at an angle to the vertical member. The vertical member is generally mounted flush against the form board and is attached to the form board by nails, screws, or other attachment means directed through apertures in the vertical member. A stake directed through the tube is driven into the ground to brace the concrete form brace and form board. The stake is driven into the ground such that it clears the top of the form board. Thus, the stake does not hinder the drawing of a screed board across the top of the form board.

A second embodiment of the concrete form brace of the present invention comprises a vertical member, integrally connected to a lower support member and an upper support member. The support members contain openings through which a stake is directed. In a first orientation, a stake is directed through the openings and driven into the ground. The openings are positioned such that the stake is directed at an angle to the vertical member. Apertures in the vertical member provide the means by which the vertical member can be attached to the form board. In an alternative orientation of the second embodiment, the lower support member is positioned against the form board and the vertical member is positioned parallel to the ground. Apertures in the lower support member are used to attached the concrete form brace to the form board. A stake is directed through an opening in the vertical member to brace the concrete form brace and form board. This embodiment may also comprise fastening devices which are used to hold the stake tightly within the brace.

A third embodiment of the concrete form brace of the present invention comprises a vertical member, integrally connected to an upper stake support member and to a lower stake support member, wherein the lower stake support member comprises a substantially horizontal portion and an angular portion. The angular portion of the lower stake support member is disposed at and end of the horizontal portion opposite the vertical member. The angular portion is disposed at an angle nearly perpendicular to a stake received within the concrete form brace. The upper stake support member and the angular portion of the lower stake support member contain openings through which a stake is directed and driven into the ground. In a first orientation of the third embodiment of the concrete form brace, the vertical member is positioned against a concrete form board and held in place by nails or other attachment devices directed through apertures in the vertical member. A stake first directed through the opening in the upper stake support member, then through the opening in the angular portion of the lower stake support member, and then into the ground provides support for the brace. In a second orientation, the substantially horizontal portion of the lower stake support member is positioned against the form board and held in place by attachment devices directed through apertures in the substantially horizontal portion. A stake first directed through the opening in the angular portion of the lower stake support member, then through the opening in the upper support member, and then into the ground provides support for the concrete brace.

DETAILED DESCRIPTION OF PREFERRED EMBODIMENTS

Figure 2:
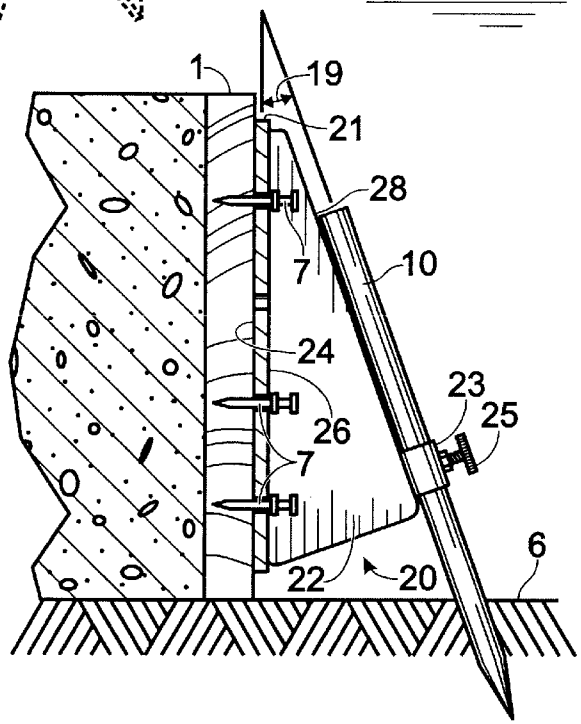
FIG. 2 shows a side view of a first embodiment of the present invention.
Figure 8:
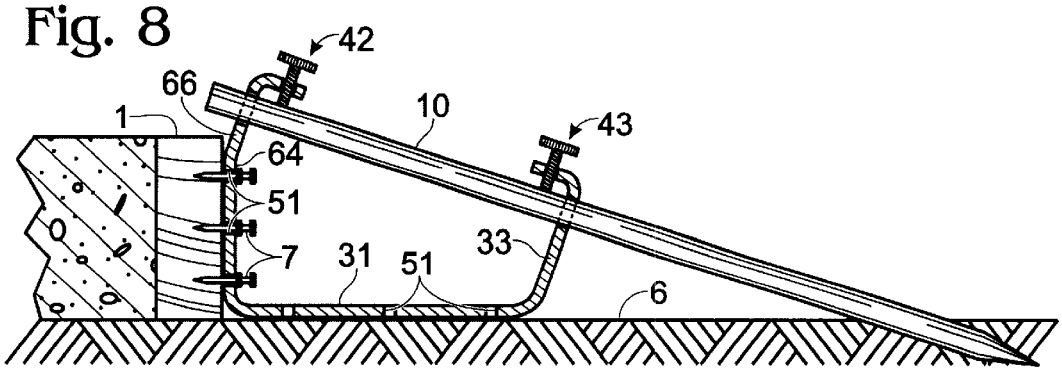
FIG. 8 shows a side view of an alternative orientation of the third embodiment of the present invention.

Preferred embodiments of the present invention are shown in the accompanying drawings in FIG. 2. through FIG. 8. It is the purpose of the present invention to support and brace concrete form boards such as the one shown at numeral 1.

Figure 3:
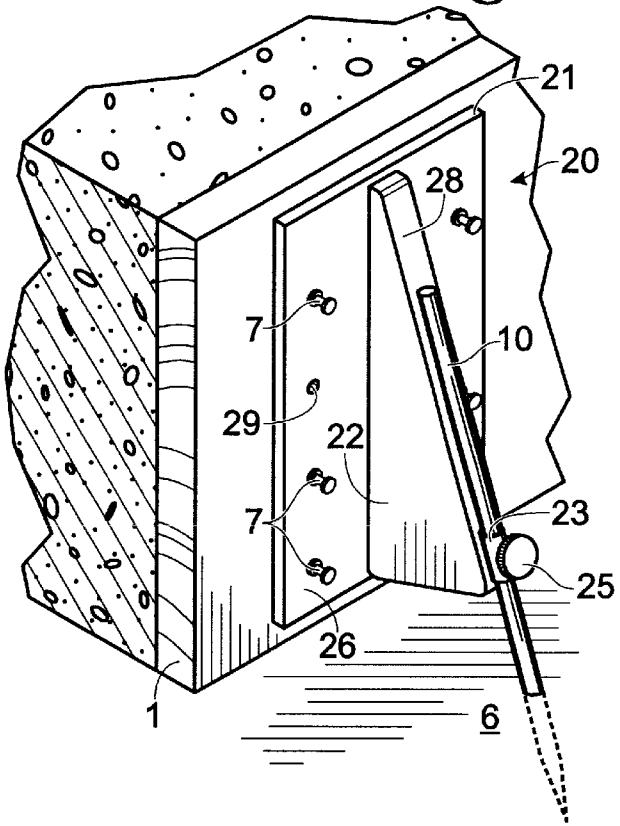
FIG. 3 shows an isometric view of a first embodiment of the present invention.
Figure 1:
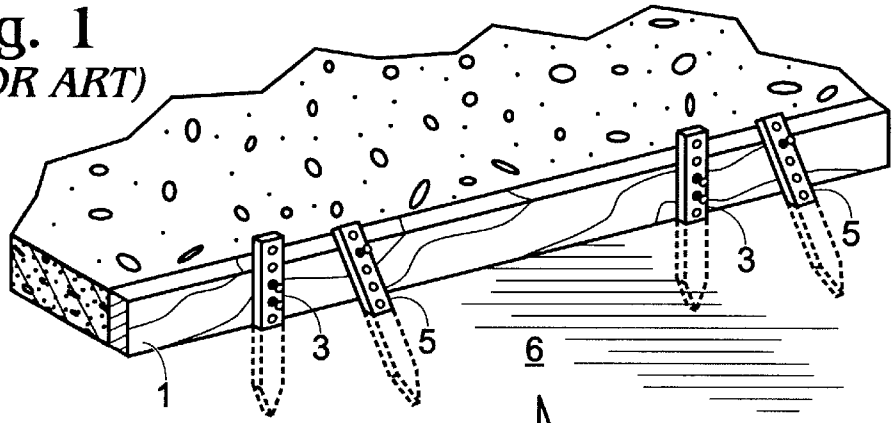
Fig. 1 (PRIOR ART)
FIG. 1 shows a prior art apparatus for holding and bracing a concrete form board.

One embodiment of the present invention is shown in particular detail in FIGS. 2 and 3. In FIGS. 2 and 3, there is shown a concrete form brace 20. The concrete form brace 20 is attached to the concrete form board 1 by nails 7 and is held in place by a stake 10. The concrete form brace 20 comprises a vertical member 21, a support member 22, and a stake holder 23.

The vertical member 21 provides a bracing surface 24 against the concrete form board 1. The front side or bracing surface 24 of the vertical member 21 is generally placed flush against the concrete form board 1. Preferably, the bracing surface 24 of the vertical member is generally flat and thus the vertical member is preferably substantially flat. The vertical member 21 is preferably sized so that its height is slightly less than the height of the form board 1. A typical size for the vertical member 21 will be 8" (20 cm) in height and 3" (8 cm) in width, although other heights and widths may be used, depending upon the size of the form board 1. Preferably, the vertical member 21 has a plurality of attachment apertures 29 which allow the concrete form brace to be attached to a form board 1 with nails, screws, or other attachment means 7.

The support member 22 provides a means for supporting the vertical member 21 by the stake 10 received within the stake holder 23. The support member 22 is attached at or near the center of the back side 26 of the vertical member 21 and projects perpendicularly from the vertical member 21. The stake holder 23 is attached at an outer edge 28 of the support member 22 that is substantially opposite from the vertical member 21. Preferably, the support member 22 is shaped so that the attachment of the holder 23 to the support member 22 allows the stake 10 to be positioned at an angle 19 to the vertical member 21 as described below.

The shape of the support member 21 should be such that a lower end of the stake 10 contained within the stake holder 23 is displaced a larger horizontal distance from the form board 1 than an upper end of the stake 10. This displacement provides that the stake 10 will be positioned at an angle 19 to the vertical member 21. Various shapes may be used to provide such angular positioning of the stake 10 by the stake holder 23. In FIGS. 2 and 3, the support member 22 is depicted as having a right triangular shape, with the vertical member 21 attached to the hypotenuse of the support member 22. The lengths of the base and the height of the right angle shape are chosen to provide the angle at which the stake is to be positioned.

The angle 19 of the stake 10 to the vertical member 21 should be such that sufficient bracing is provided for the form board. Preferably, this angle is between 15 and 25 degrees. However, the angle 19 may be as small as 0 degrees where the stake 10 is positioned parallel to the form board 1. The present invention may also provide an angle 19 larger than 25 degrees, but such an angle 19 may limit access to the stake 10 or limit the effectiveness of the bracing provided.

The stake holder 23 provides a means for receiving the stake 10 that will hold the concrete form board 1 in place during the concrete forming process. Preferably, the stake holder 23 is located towards the lower portion of the outer edge 28 of the support member 22 to ease the insertion of the stake 10 into the stake holder 23. The stake holder 23 may comprise a tube having sufficient length to hold a stake within it and to prevent the stake from pivoting within the stake holder 23. A typical length for the tube would be from one inch (2 cm) to two inches (5 cm). The cross-section of the tube may have a circular shape for receiving stakes made of metal, wood, or other materials with a circular cross-section. Alternatively, the cross-section of the tube may have a rectangular shape for receiving a stake made of metal, wood, or other materials, with a rectangular cross-section.

As an alternative, the stake holder 23 may comprise two or more rings mounted at various points along the outer edge 28 of the support member 22. The rings are mounted so as to receive a stake 10 positioned along and parallel to the outer edge 28 of the support member 22. The rings have have substantially circular or rectangular shapes. As an additional alternative, the stake holder may comprise two or more substantially flat plates oriented perpendicular to the stake 10 and mounted on the outer edge 28 of the support member 22. The flat plates contain openings through which the stake 10 is directed. As described above, the openings may be substantially circular or rectangular, depending upon the type of stake to be held.

The stake holder 23 may include a stake securing means 25. The stake securing means 25 serves to hold a stake in place once it is positioned within the stake holder 23. The stake securing means 25 may comprise a set screw or lock bolt which is tightened against a stake within the stake holder 23. Other stake securing means may include fastening devices such as a lever, cam, wedge, or other devices which provide that the stake 10 is held fast within the stake holder 23. If a wooden stake is to positioned within the stake holder 23, the stake securing means 25 may comprise an aperture through which a nail is driven into the wooden stake.

Preferably, the vertical member 21 and support member 22 are constructed from separate pieces of ⅛" to ¼" steel plate, although other material or thicknesses may be used. The stake holder 23 may be formed by bending a steel plate into a rectangular or circular tubular shape, by cutting a length of steel tubing, or by using the rings or plates discussed above. The separate pieces may be welded or soldered together. Alternatively, the concrete form brace 20 may be created by casting or molding the required shape from metal or other materials.

Figure 5:
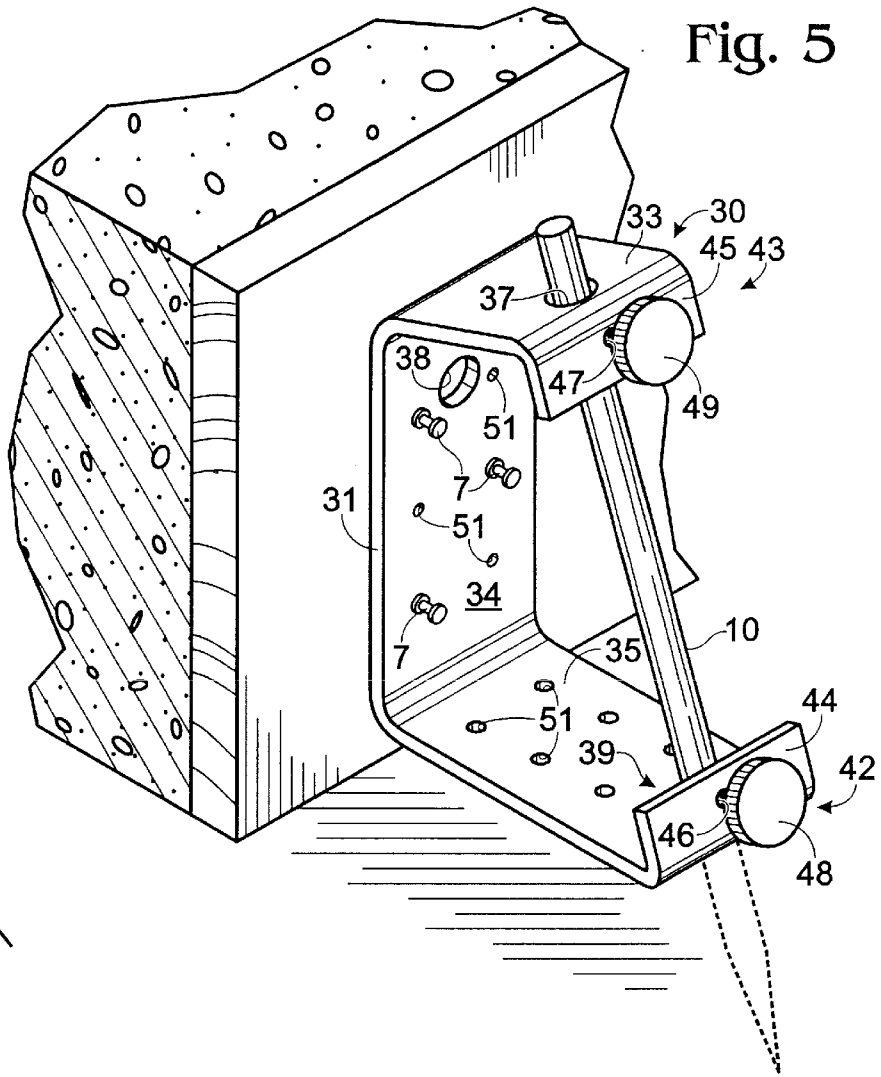
FIG. 5 shows an isometric view of a second embodiment of the present invention.
Figure 4:
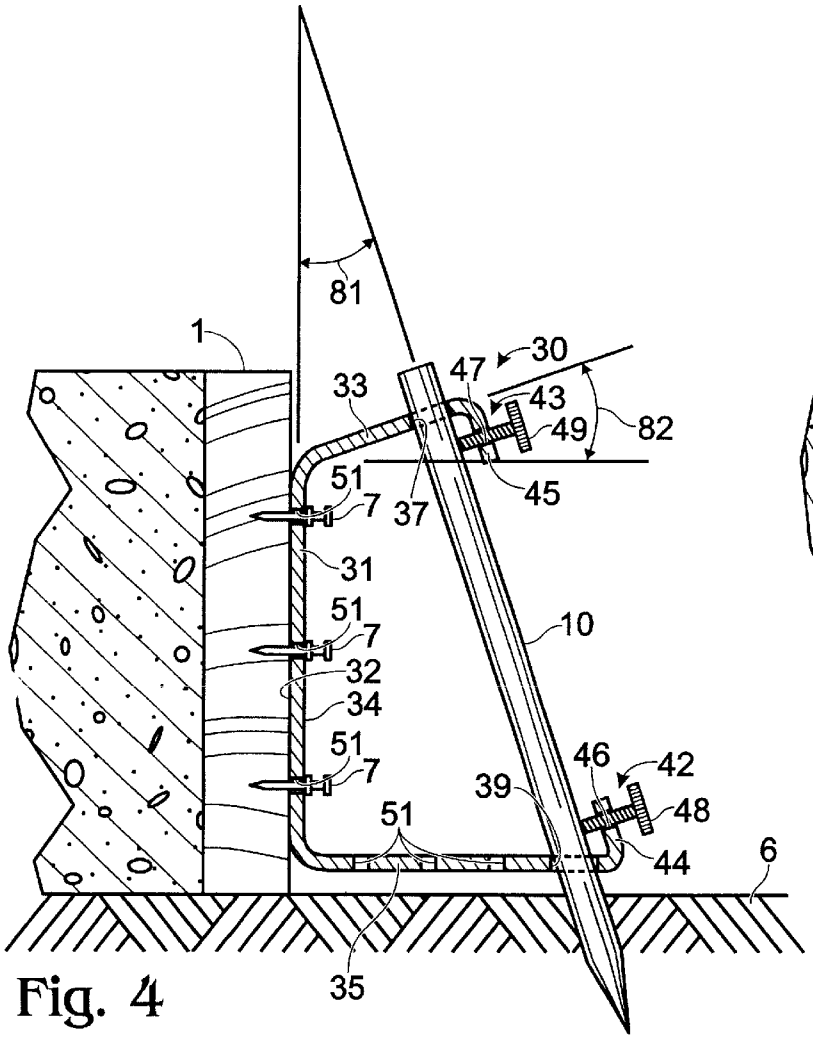
FIG. 4 shows a side view of a second embodiment of the present invention

A second embodiment,of the present invention is shown in particular detail in FIGS. 4 and 5. In FIGS. 4 and 5, there is shown a concrete form brace 30 in accordance with the present invention. The concrete form brace 30 comprises a vertical member 31, a lower stake support member 35, an upper stake support member 33, a lower stake holder 39, and an upper stake holder 37. The concrete form brace 30 is attached flush against the concrete form board 1 by nails 7. A stake 10 directed through the upper stake holder 37 and the lower stake holder 39 and driven into the ground 6 braces the concrete form brace 30 against concrete or other material poured against the concrete form board 1. The stake 10 is driven so that it is clear of the top of the concrete form board 1.

As shown in FIGS. 4 and 5, the vertical member 31 provides a bracing surface 32 against the concrete form board 1. The front side or bracing surface 32 of the vertical member 31 is generally placed flush against the concrete form board 1. Preferably, the bracing surface 32 is generally flat and therefore the vertical member 31 is preferably substantially flat. Preferably, the vertical member 31 has a plurality of attachment holes 51 which allow the concrete form brace 30 to be attached to the form board 1 with nails, screws, or other attachment means 7 directed through the attachment apertures 51. Typically, the vertical member is from 6 inches (15 cm) to 8 inches (20 cm) in height and approximately 3 inches (8 cm) wide, although other heights and widths may be used.

The vertical member 31 may also contain a stake hole 38 through which a stake can be driven in the alternative orientation of the concrete form brace 30 discussed below. The stake hole 38 will generally be disposed towards the upper edge of the vertical member 31. The stake hole 38 may be generally circular in shape and sized for the receipt of standard size circular stakes or may be generally rectangular for the receipt of standard size rectangular stakes. For circular stakes, the stake hole 38 may be from ½ inch to 1 inch in diameter, although other diameters would also suffice. For rectangular stakes, the stake hole 38 may have dimensions from 1 inch by 1 inch to 2 inches by 2 inches, but the stake hole 38 may be sized to accommodate other sizes of rectangular stakes.

The lower stake support member 35 is disposed at the lower end of the vertical member 31 and projects outwardly from the back side 34 of the vertical member 31. Preferably, the lower stake receiving member 35 is disposed perpendicular or nearly perpendicular to the vertical member 31. The lower stake receiving member 35 contains a lower stake holder 39. Preferably, the lower stake holder 39 comprises an opening through the lower stake support member 35. The stake holder 39 may be generally circular in shape and sized for the receipt of standard circular stakes. Alternatively, the stake holder 39 may be generally rectangular in shape and sized for the receipt of rectangular stakes. An alternative stake holder 39 may comprise the tube 23 described for the embodiment shown in FIGS. 2 and 3. Preferably, the lower stake holder 39 is disposed towards an end of the lower stake support member 35 opposite the flat vertical member 31.

The upper stake support member 33 is disposed at the upper end of the vertical member 31 and projects outwardly from the back of the vertical member 31. Preferably, the upper stake support member 33 is disposed at an angle 82 to the vertical member 31 that is generally equal to the angle 81 of the stake 10 to the vertical member 31. However, the upper stake support member 33 may be disposed in a perpendicular or nearly perpendicular direction to the vertical member 31. The upper stake support member 33 contains an upper stake holder 37. Preferably, the upper stake holder 37 comprises an opening through the upper stake support member 33. As in the case of the lower stake holder 39, the opening for the upper stake holder 37 may have a generally circular or rectangular shape. As discussed above, an alternative stake holders is the tube 23 described for the embodiment shown in FIGS. 2 and 3. Preferably, the upper stake holder 37 is horizontally disposed closer to the vertical member 31 than the lower stake holder 39. With the upper stake holder 37 and lower stake holder 39 separated horizontally as described, the stake 10 directed through both the upper stake holder 37 and lower stake holder 39 will be positioned at an angle 81 to the vertical member 31. Preferably, the angle 81 will be between 15 and 25 degrees, although other values for the angle 81 may be accommodated by the present invention.

An alternative embodiment of the present invention is provided by horizontally disposing the lower stake holder 39 closer to the vertical member 31 than the upper stake holder 37. In this embodiment, the stake 10 will be driven towards the concrete form board 1 such that the angle 81 to the vertical member 31 will be negative. Preferably, the angle 81 to the vertical member 31 will be between −15 and −25 degrees, although other values for the angle may be accommodated by this embodiment of the present invention.

The lower stake support member may include a lower stake securing means 42. The lower stake securing means may comprise a lower flange 44 located at an end of the lower stake support member 35 opposite the vertical member 31. The lower flange 44 has an opening 46 which is adjacent the stake 10 received by the upper stake holder 37 and the lower stake holder 39. To secure wooden stakes, a nail may be driven through the opening 46 into a stake held in the concrete form brace 30. Alternatively, the opening 46 may be adapted for receipt of a fastening device 48 such as a thumbscrew, lock bolt, lever, cam, wedge, or other device which can be tightened against the stake 10 held in the concrete form brace 30.

Similarly, the upper stake support member may also include an upper stake securing means 43. The upper stake securing means may comprise an upper flange 45 located at the end of the upper stake support member 33 opposite the vertical member 31. The upper flange has an opening 47 which is adjacent a stake received by the upper and lower stake receiving means. To secure wooden stakes, a nail may be driven through the opening 47 into a stake held by the stake receiving means. Alternatively, the opening 47 may be adapted for receipt of a fastening device 49 such as a thumbscrew, lock bolt, lever, cam, wedge or other device which can be tightened against the stake 10 held by the concrete form brace 30.

Figure 6:
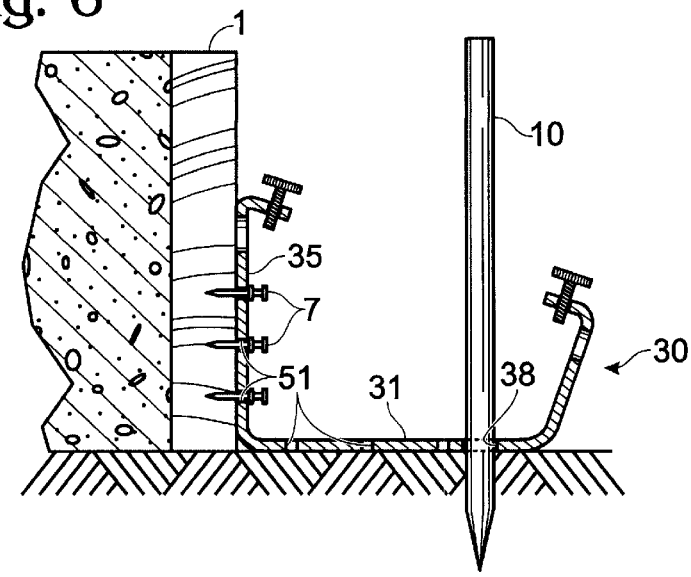
FIG. 6 shows a side view of the second embodiment of the present invention in an alaternative orientation.

For concrete form boards taller than 8 inches (20 cm), the concrete form brace 30 may be oriented as shown in FIGS. 4 and 5, where the vertical member 31 is attached flush against the concrete form board 1. For concrete form boards shorter than 8 inches (20 cm), an alternative orientation as shown in FIG. 6 may be used. In this orientation, the lower stake support member 35 is mounted flush against a concrete form board 1 and the vertical member 31 is oriented parallel to the ground. A stake 10 driven through the stake hole 38 and into the ground 6 serves to hold the concrete form brace 30 in place. For use in this orientation, the lower stake support member 35 preferably has a plurality of attachment apertures 51 which allow the lower stake support member to be attached to a form board with nails, screws, or other attachment means 7 directed through the attachment apertures 51.

Preferably, the vertical member 31, lower stake support member 35, upper stake support member 33, lower flange 44, and upper flange 45 are formed by bending a single piece of ⅛ inch to ¼ inch steel plate into the disclosed shape. Alternatively, the concrete form brace 30 may be formed by welding together the various members. The concrete form brace 30 may also be formed by molding metal to create the required form. Other materials such as high strength plastic or graphite may also be used to form the present invention.

Figure 7:
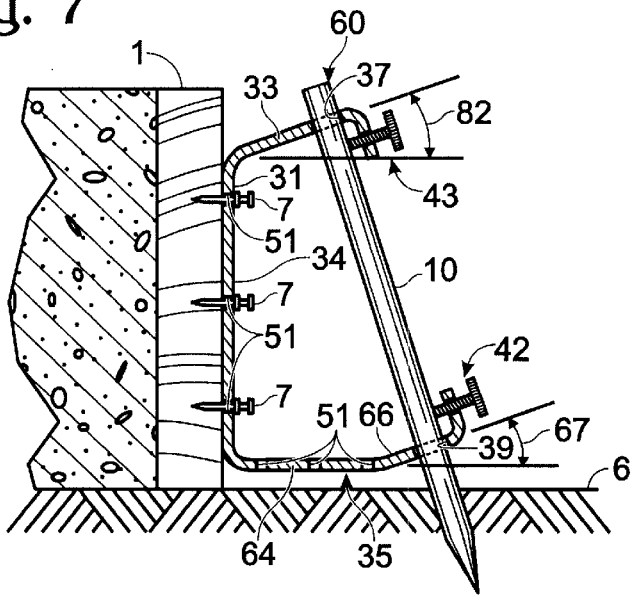
FIG. 7 shows a side view of a third embodiment of the present invention.

Another embodiment of the present invention is shown in FIGS. 7 and 8. The concrete form brace 60 of this embodiment is similar to the concrete form brace 30 depicted in FIGS. 4–6, except that the lower stake support member 35 is provided by a horizontal portion 64 attached to or integral with an angular portion 66. The horizontal portion 64 projects outwardly from the back side 34 of the vertical member 31. Preferably, the horizontal portion 64 is disposed perpendicular or nearly perpendicular to the vertical member 31. The angular portion 66 is disposed at an end of the horizontal portion 64 opposite the vertical member 31 and projects outwardly from the horizontal portion 64. The angular portion is disposed at an angle 67 to the horizontal portion 64. Preferably, the angle 67 between the angular portion 66 and the horizontal portion 64 is equal or nearly equal to the angle 82 between the upper stake support member and the vertical member 31. The angular portion contains the lower stake holder 39. The angular portion may also include a lower stake securing means 42.

In its first orientation, the concrete form brace 60 is attached to a concrete form board 1 by nails or other attachment means 7 directed through the attachment apertures 51. A stake is directed through the upper stake holder 37 and the lower stake holder 39 and is driven into the ground 6. The stake may be secured to the concrete form brace by the upper stake securing means 43 and/or the lower stake securing means 42. In this orientation, the concrete form brace 60 can provide bracing for tall concrete form boards.

The concrete form brace 60 can also be deployed in an alternative orientation as shown in FIG. 8. In this orientation, the horizontal portion 64 is attached to the concrete form board 1 by attachment means 7. The vertical member 31 is oriented on or close to and parallel to the ground. A stake 10 is directed through the lower stake holder 39 and the upper stake holder 37 and is driven into the ground 6. This orientation of the concrete form brace 60 allows it to be used for shorter concrete form boards 1 while still providing some measure of clearance from the top of the form board 1.

Preferably, the concrete form brace 60 comprising of the vertical member 31, lower horizontal member 64, angular member 66, upper stake support member 33, lower flange 44, and upper flange 45 is formed by bending a single piece of ⅛ inch to ¼ inch steel plate into the disclosed shape. Alternatively, the concrete form brace may be formed by welding together the various members. The concrete form brace 60 may also be formed by molding metal to create the required form. Other materials such as high strength plastic or graphite may also be used to form the present invention.

From the foregoing description, it will be apparent that the present invention has a number of advantages, some of which have been described above, and others of which are inherent in the embodiments of the invention described above. Also, it will be understood that modifications can be made to the concrete form brace described above without departing from the teachings of subject matter described herein. As such, the invention is not to be limited to the described embodiments except as required by the appended claims.

What is claimed is:

1. A concrete form brace adapted to be positioned against a concrete form board and braced by a stake, comprising:

a substantially vertical member having a front surface and a back surface;

a stake holder;

a stake support member, said stake support member attached to or integral with the back surface of said vertical member and attached to or integral with said stakeholder, and adapted to position a stake at a fixed angle to said vertical member;

wherein said stake support member comprises an upper stake support member disposed at an upper edge of said vertical member, said upper stake support member being substantially flat and elongate and projecting outwardly from the back surface of said vertical member, and a lower stake support member disposed at a lower edge of said vertical member, said lower stake support member being substantially flat and elongate and projecting substantially perpendicular from the back surface of said vertical member, and wherein said stake holder comprises an upper stake holder disposed within said upper stake support member, and a lower stake holder disposed within said lower stake support member; and wherein said lower support member comprises a substantially horizontal portion, said substantially horizontal portion being disposed adjacent the back of said vertical member, and an angular portion attached to or integral with said substantially horizontal portion at an end of said substantially horizontal portion opposite said vertical member, said angular portion projecting from said substantially horizontal portion in a substantially perpendicular direction to a stake provided in said stake support member, and wherein said lower stake holder is disposed within the angular portion of said lower support member.

2. A concrete form brace according to claim 1 wherein said vertical member contains a plurality of apertures through which attachment means are directed to attach said concrete form brace to said concrete form board.

3. A concrete form brace according to claim 1 wherein said stake holder further comprises a stake securing means, said stake securing means engaging a stake to hold it fixedly in place.

4. A concrete form brace according to claim 1 wherein said upper stake support member further comprises a flange located at an end of said upper stake support member opposite said vertical member, said flange having an opening adjacent to said stake.

5. A concrete form brace according to claim 4 wherein said opening is adapted to receive a fastening device, said fastening device being tightenable against a stake.

6. A concrete form brace according to claim 4 wherein said lower stake support member further comprises a flange located at an end of said lower stake support member opposite said vertical member, said flange having an opening adjacent to a stake.

7. A concrete form brace according to claim 6 wherein said opening is adapted to receive a fastening device, said fastening device being tightenable against a stake.

8. A concrete form brace according to claim 1 wherein said lower stake support member further comprises a plurality of apertures.

9. The concrete form brace according to claim 1 wherein said substantially horizontal portion further comprises a plurality of attachment apertures.

10. A concrete form brace, comprising:

a substantially vertical member having a front surface and a back surface;

a stake holder; and a stake support member, said stake support member attached to or integral with the back surface of said vertical member and attached to or integral with said stakeholder, and adapted to position a stake at a fixed angle to said vertical member;

wherein said stake support member comprises an upper stake support member disposed at an upper edge of said vertical member, said upper stake support member being substantially flat and elongate and projecting outwardly and upwardly from the back surface of said vertical member; and a lower stake support member disposed at a lower edge of said vertical member, said lower stake support member being substantially flat and elongate and projecting substantially perpendicular from the back surface of said vertical member, and wherein said stake holder comprises an upper stake holder disposed within said upper stake support member and a lower stake holder disposed within said lower stake support member.

11. A concrete form brace according to claim 10 wherein said vertical member includes an opening for insertion of a stake therethrough.

12. A concrete form brace according to claim 10 wherein said upper stake holder comprises an upper opening within said upper stake support member, said upper opening having a size and shape adapted to receive a stake inserted generally perpendicular to a plane of said upper stake support member, and said lower stake holder comprises a lower opening within said lower stake support member, said lower opening having a size and shape adapted to receive a stake and said lower opening horizontally displaced from said vertical member at a farther distance from said vertical member than said upper opening.

13. A concrete form brace according to claim 10 wherein said vertical member contains an opening with a size and shape adapted to receive a stake.

* * * * *